United States Patent [19]

Jędo et al.

[11] 4,071,440

[45] Jan. 31, 1978

[54] METHOD AND APPARATUS OF STRATIFICATION WITH TANGENTIAL FEED

[75] Inventors: Antoni Jędo, Gliwice; Wacław Jachna, Tychy; Adolf Szczęsny, Zabrue, all of Poland

[73] Assignee: Centralny Osrodek Projektowokonstrukocyjny Maszyn Gorniczych "Komag", Gliwice, Poland

[21] Appl. No.: 707,663

[22] Filed: July 22, 1976

[30] Foreign Application Priority Data

July 28, 1975 Poland ..... 182377

[51] Int. Cl.[2] ..... B03B 5/20

[52] U.S. Cl. ..... 209/44; 209/457; 209/497

[58] Field of Search ..... 209/44, 13, 455–457, 209/425–427, 491, 496, 497, 498, 459

[56] References Cited

U.S. PATENT DOCUMENTS

| | | | |
|---|---|---|---|
| 128,628 | 7/1872 | Hungerford | 209/498 X |
| 2,134,154 | 10/1938 | Smith | 209/425 |
| 2,199,091 | 4/1940 | Pardee | 209/455 |
| 3,273,714 | 9/1966 | Cleaveland | 209/456 |
| 3,519,130 | 7/1970 | Jachna | 209/234 |
| 3,674,144 | 7/1972 | Muller et al. | 209/475 X |
| 3,773,176 | 11/1973 | Loughner | 209/459 |
| 3,844,414 | 10/1974 | Jordison | 209/144 X |

*Primary Examiner*—Frank W. Lutter
*Assistant Examiner*—Ralph J. Hill
*Attorney, Agent, or Firm*—Haseltine, Lake & Waters

[57] ABSTRACT

Method of separation of a mixture of mineral grains with differentiated specific gravity, under the conditions of a restricted sedimentation, in a cylindrical device, consists therein that the mixture A of the mineral with water is radially supplied to a trough 2 formed around the upper edge of the wall 1 of the water box. The mineral circulating in the trough 2 is desludged and partially separated according to the weight of the grains, and then, under pulsating action of the water, is displaced in a ring-shaped working trough along spiral trajectories towards the conduit 17 and 19 taking out the light fraction D and towards the conduits with a flap 16 for discharge of the heavy fraction C. The pulsating motion of the water is effected by compressed air being cyclically fed to the ring-shaped air chamber 6 via the pulsation valves 14 from a ring-shaped tank 5 arranged around the water box. From the air chamber 6 additional air chambers 7 extend radially beneath the sieve deck 7.

11 Claims, 7 Drawing Figures

METHOD AND APPARATUS OF STRATIFICATION WITH TANGENTIAL FEED

FIELD OF THE INVENTION

This invention relates to a method of separation of mineral grains in an aqueous medium with restricted sedimentation of grains having different specific gravities, and to a device for application of this method. Said method and device are applicable for enrichment of useful minerals, and especially to coal wet cleaning and ore dressing.

BACKGROUND

In the course of the process of mineral enrichment according to known methods, the mineral grains are displaced in enrichment plants under the influence of a pulsating motion of water and the thrust of the supplied mass of raw material, along trajectories lying in vertical planes running directly from the place of delivery of the material fed mechanically for dressing to the place of receiving the products being enriched. The length of the path necessary to perform the separation of the mixture of the mineral grains, and thus the length of the entire device employed for the enrichment constitutes a characteristic value to estimate the effectiveness of the method of enrichment and of the design of the enrichment devices.

There are known methods of enrichment of minerals under restricted sedimentation of grains in a pulsating and flowing aqueous medium, according to which the raw mixture of minerals before the enrichment process is submitted to a desludging process, in a separate operation, consisting in removing the finest grains from the raw material. The desludging process is realized according to known methods beyond the enrichment device. Said principles concern also, and form a basis of designing jigs having a cylindrical or approximately to cylindrical form.

From the Russian Pat. No. 195,997, a cylindrical jig is known in which the raw material is supplied, the heavy fraction being taken off from a ring-shaped working trough adjacent to the central axis, the light fraction on the other hand being drained off at the entire periphery of the water box.

From the French Pat. No. 1,269,592, a cylindrical jig is known, in which the raw material is supplied near the central axis of the jig, the heavy and the light fractions being taken off through receivers located near the external wall of the jig.

In a known cylindrical jig, according to the German Pat. No. 47,967, the raw material is supplied in at the central axis on a conical surface over which it flows in a radial direction into a working trough near the external wall thereof. The raw material is separated within said trough after according to the specific gravity of the grain and is displaced radially from the external wall towards the central axis. The light fraction flows out through a trap offtake arranged below the sieve deck, the heavy fraction being taken off through the holes of the sieve deck.

In the known cylindrical jigs mentioned hereinabove, in course of the separation process of mineral grains, independently of the manner of supplying the raw material and of taking off of the separation products, the grains are displaced along vertical radial planes.

SUMMARY OF THE INVENTION

The method of separation of a mixture of mineral grains in an aqueous medium in cylindrical or similar devices, according to the invention, consists of supplying the raw mixture with water tangentially to the external wall of the device with an initial velocity securing the circulation of the mixture at least near the upper edge of the device. Within the circulating stream, the mixture is preliminarily separated after according to the specific gravity of the grain and the grain size, in consequence of differentiated velocity of flow of grains, in accordance with the distance of separate grains from the surface. The preliminarily separated mixture then flows, under the thrust of the steady supplied raw mixture, along helical trajectories converging towards the central axis. During said helical flow, the mixture is submitted to a pulsating action of water, which causes the complete separation of grains into the light and the heavy fraction. From the stream of the mixture, circulating near the upper edge of the external wall of the device, a portion of said mixture, comprising only the finest grains, is discharged outside the device.

A device according to the present invention, for separation of a mixture of mineral grains, comprises a jig, provided with a water box having a cylindrical or similar form in which there are built-in ring-shaped air chambers open from the bottom, the sieve deck having a form of an upturned truncated pyramid or cone. The upper edge of the external wall of the water box is shaped in the form of a trough opened towards the central axis of the jig. Below said trough on the side of the external wall of the water box is an equalizing tank for compressed air and a collector for the expanded air. At the inner side of the wall of the water box, below said trough, is a pulsating air chamber reaching partially above the sieve deck. The air chamber has the form of a circular or polygonal ring, and is opened from the bottom. The sieve deck is provided with holes, preferably approximately parallel to the generating line of the sieve cone.

The trough above the upper edge of the external wall is divided in an external and an internal part by means of a slotted sieve with ports being approximately to the generating line. Into the internal part of said trough inlet nozzles are introduced tangentially to the periphery, supplying the jig with the mixture of raw material with water.

Inside the jig water box, a ring-shaped air chamber is provided, into which via the pulsating valves compressed air is fed in and discharged therefrom. The air chamber is divided into two or more sections, each of which co-operates with a separate pulsation valve.

In order to produce a more intensive pulsating flow of water, the jig is provided under the sieve deck with additional air chambers open from the bottom, being radially traced from the sections of the ring-shaped air chamber.

The sieve deck is supported by its larger base on the wall of the ring-shaped air chamber, and by its smaller base on the upper edge of the housing of the receiver of the heavy fraction. The receiver of the heavy fraction is a cylindrical vertical conduit whose outlet hole is provided with a flap having the form of a disk coupled with a drive for displacing the flap.

The advantage of the method according to the invention is that on setting the mixture of the raw material with water in circulating motion near the external wall of the jig, a uniform distribution of the mineral grains on the entire external circumference of the cylindrical jig is secured, as well as the desludging thereof which is associated with an increase of the effectiveness and shortening of the duration of the separation process.

BRIEF DESCRIPTION OF THE DRAWING

The flow of streams of the mixture of mineral grains in an aqueous medium, being separated according to the method according to the invention is illustrated in the accompanying drawing in which.

DETAILED DESCRIPTION

Figure 1:
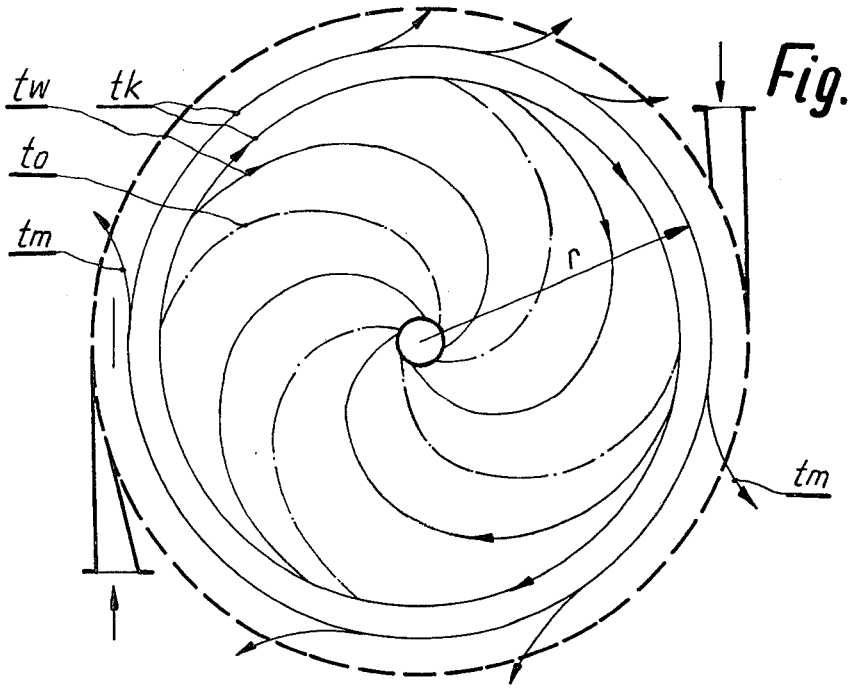
FIG. 1 is the diagrammatic view of the flow of streams within a cylindrical jig.
Figure 2:
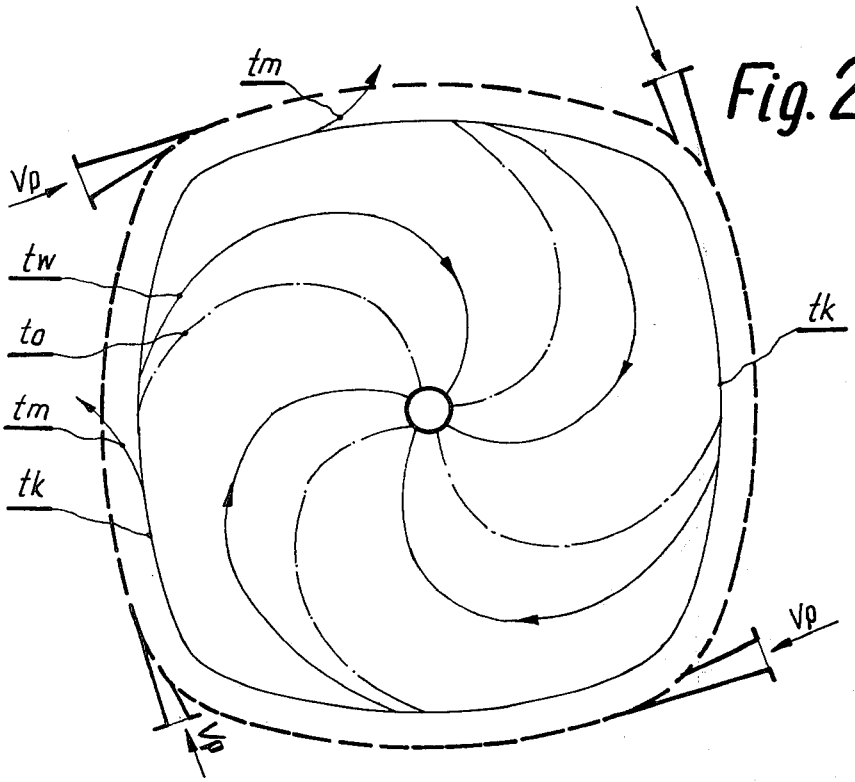
FIG. 2 shows the flow of streams in a jig having the form approximated to a rectangle, with four inlets of the mixture.

Referring to FIGS. 1 and 2, the mixture of mineral and water is supplied tangentially to the external wall of the jig with an initial velocity $Vp$ to obtain circulation of the mixture to along trajectory *tk* at least near the upper edge of the external wall of the water box. The circulating stream of the mixture is desludged on the slotted sieve, the finest grains flowing with water outside the jig on trajectories *tm*, and the remaining portion flowing on spiral trajectories *tw* and to towards the central axis. The light fraction flows along trajectories *tw*, whereas the heavy fraction is displaced along trajectories to. As a result of circulation of the suspension on trajectories *tk* and the flow on spiral trajectories *tw* and to the complete separation of the mixture is obtained.

Figure 3:
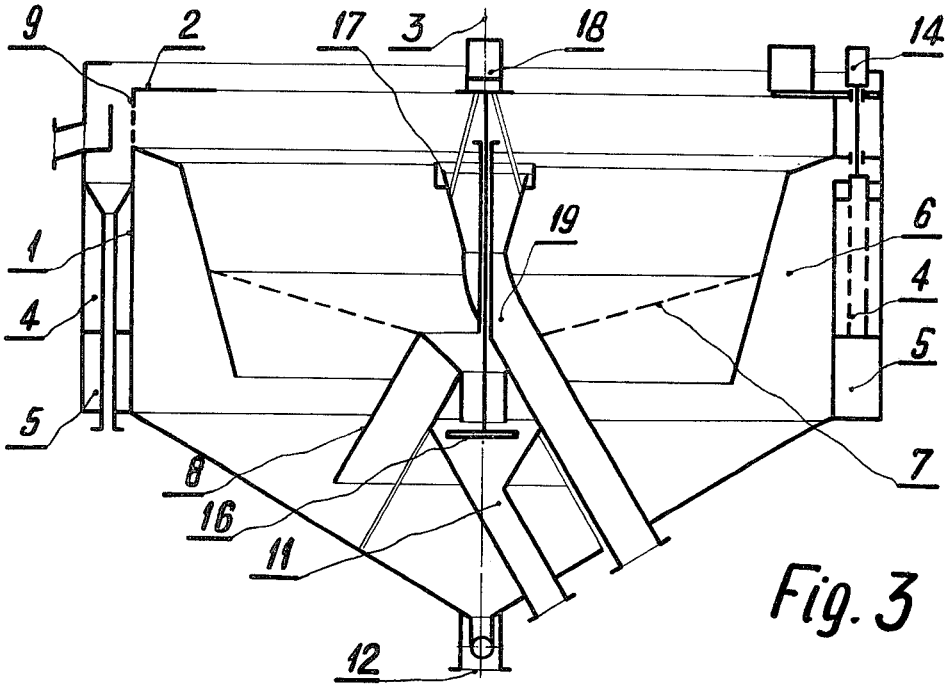
FIG. 3 is a vertical sectional view, along the central axis, of the jig.
Figure 4:
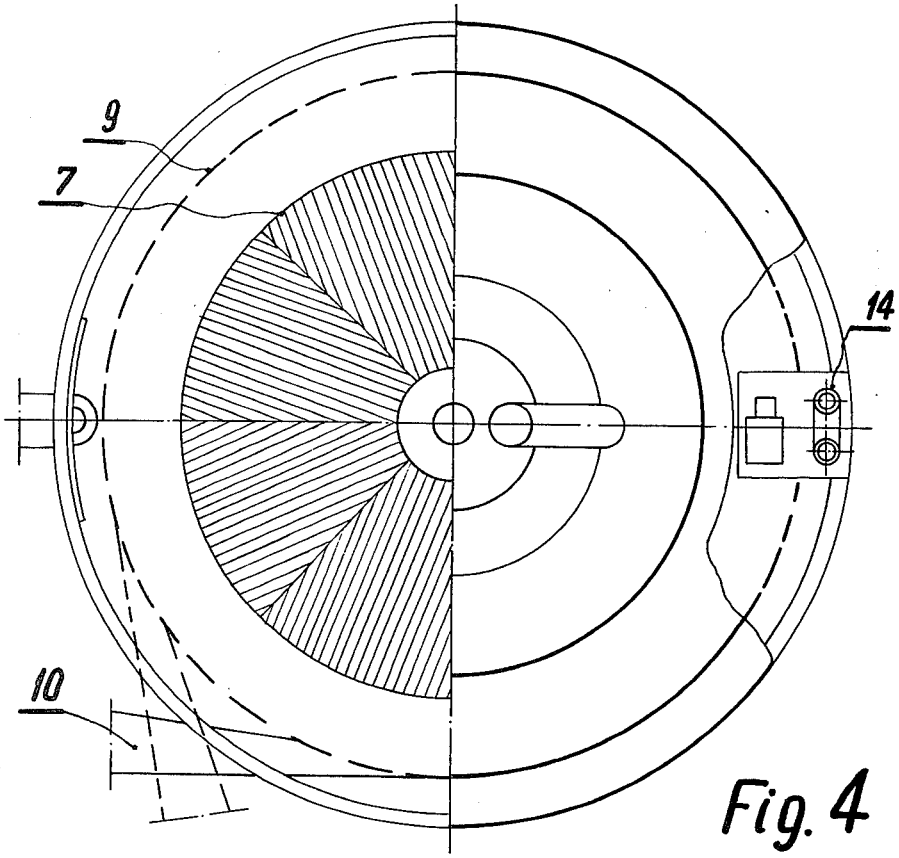
FIG. 4 is a top view of the jig.

The cylindrical jig, as shown in FIGS. 3 and 4, is provided with a water box in which the upper edge of the external wall 1 is shaped in the form of a trough 2 open towards the central axis 3. The trough is provided with slotted sieve 9 having slots arranged parallel to the generating line of the cylinder. Introduced into the interior of the sieve trough 2 is inlet nozzle 10 for supplying the mixture of raw mineral with water, with an initial velocity obtain the circulation of said mixture within said trough. Said nozzle may be re-mounted in order to provide an opposite direction of circulation of the mixture in the jig. In the external part of the trough 2, the filtered material is collected, which is a suspension of the finest grains of the raw mineral in water. On the external side of the wall 1, below the trough 2, an equalizing tank 4 for compressed air is provided, and a collector 5 for the expanded air. From the tank 4 the compressed air flows through the inlet of a pulsation valve 14 into the air chamber 6, wherefrom, on performing the work, the air flows out through the outlet of the pulsation valve 14 into the collector 5. The air chamber 6 is formed below the sieve trough 2 on the inner side of the wall 1 of the water box, whereas its upper part protrudes over the sieve deck 7. Said deck 7, having the form of an upturned truncated cone or pyramid, is supported by its larger base on the wall of the air chamber 6, and by its smaller base on the housing of the heavy fraction receiver 8. The sieve deck is made of plates or rods fastened disconnectably, or as shutters with adjustable slope angles. The receiver of the heavy fraction constitutes a section of a conduit having at its lower end a flap 16 in the form of a disk coupled by a link with a drive 18. In dependence on the amount of the heavy fraction on the sieve deck 7, near the central axis 3, the flap 16 is lowered or lifted. The light fraction flows by gravity from the jig, together with water, through the drains 17 and 19. The heavy fraction falls by gravity into the conduit 11, and the fraction screened by deck 7 flows into the conduit 12, fractions then flowing to dewatering plants.

Figure 5:
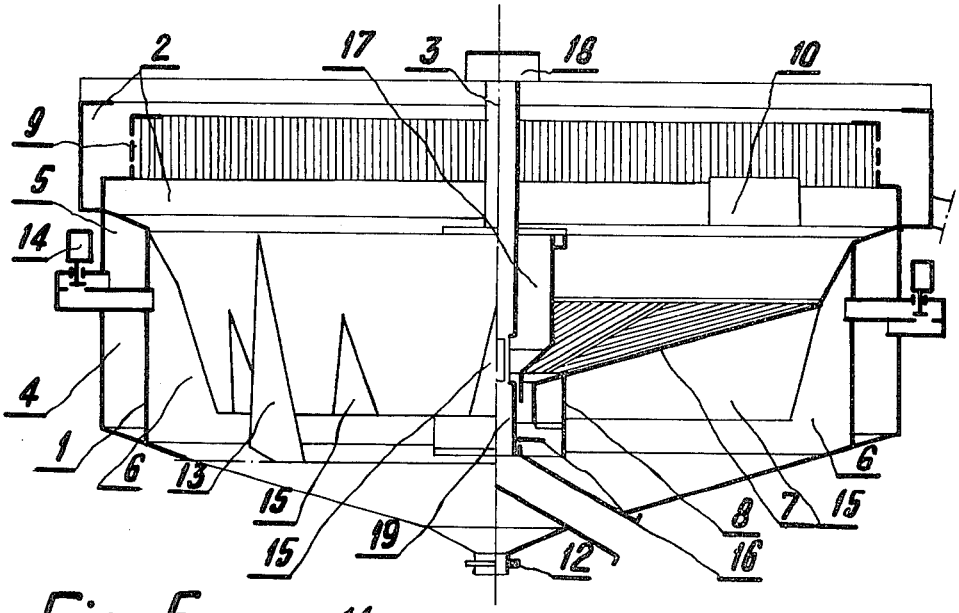
FIG. 5 is the vertical sectional view of the jig, taken partially along the axis of the jig, and partially along the external wall of the water box.
Figure 6:
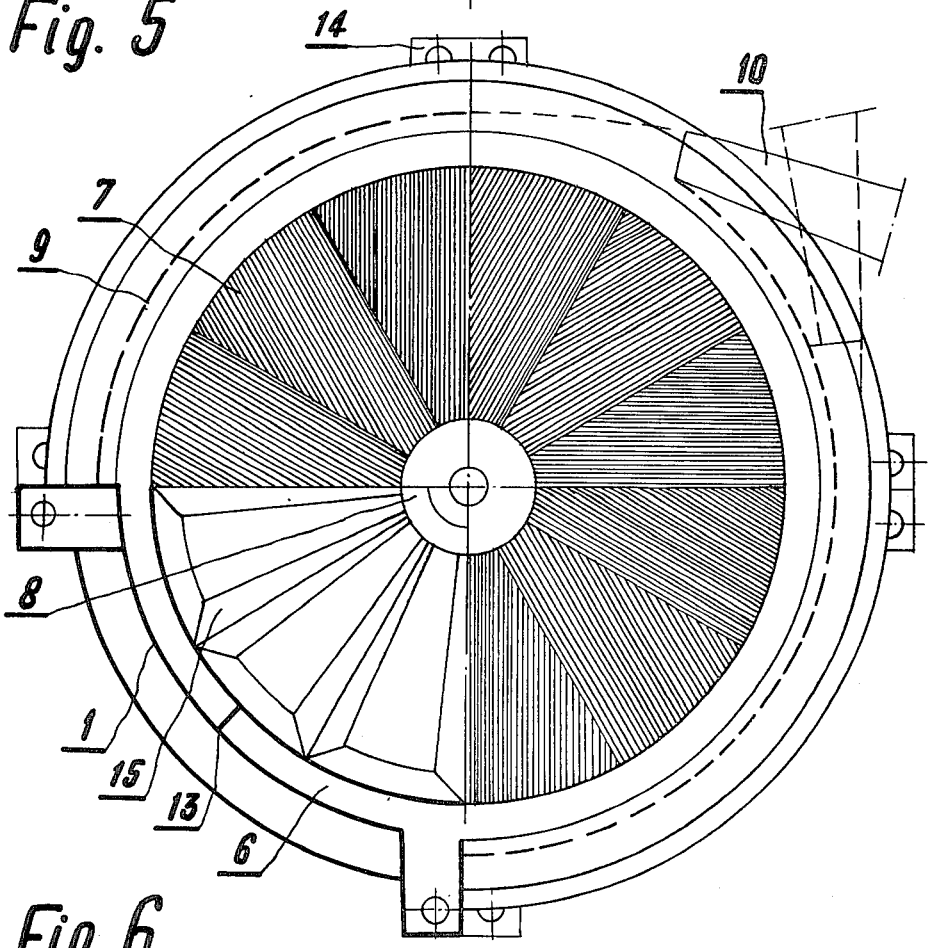
FIG. 6 is a top view of the jig, with a partially removed sieve deck and in a horizontal sectional view through the trough.

In FIGS. 5 and 6 a high-duty jig is shown, for enrichment of minerals requiring an intensive pulsation of water, as for instance minerals containing a high content of heavy fraction. The sieve 9 in the trough 2 is extended slightly over the bottom of the trough in order to limit the wear thereof under the action of highly abbrasive grains. For the same purpose the possibility is provided of changing the direction of flow of the mixture into the jig through the inlet nozzles 10. The ring-shaped air chamber 6 is divided into four sections, by means of vertical radial partitions 13. From each section of the ring-shaped chamber 6, below the sieve deck 7, three additional chambers 15 are formed, arranged radially to the housing 8 of the heavy fraction receiver. The sieve deck 7 is provided with holes arranged approximately parallel to the generating line of the cone. The light fraction with water is taken off through the pipe conduit 17 and the pipe conduit 19, forming at the same time an element transmitting the rotational motion from the drive 18 to the flap 16 of the heavy fraction receiver, and through the opening in the flap 16. The heavy fraction taken off from the sieve deck 7 falls by gravity out of the flap 16 onto the bottom of the water box, wherefrom, together with the sieved fraction passing through deck 7 it is taken off through the opening 12.

Figure 7:
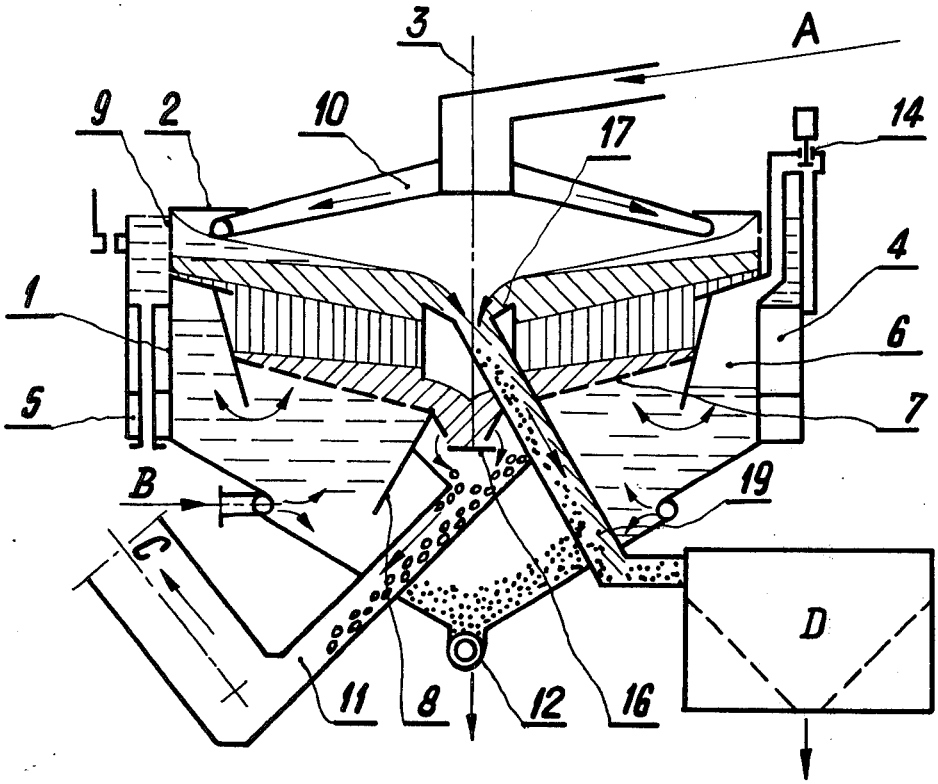
FIG. 7 is a diagrammatic illustration of the jig installation in a cooperating plant.

The diagrammatical view of the jig, together with co-operating apparatus for the realization of the method according to the invention is shown in FIG. 7.

The raw mineral with water A is supplied tangentially to the trough 2 by inlet nozzles 10. Water B is supplied to the jig through the openings in the bottom. The suspension circulating in the trough 2 is desludged by the sieve 9. The desludged mineral is then displaced above the sieve deck 7, by the pulsating motion of the water, along spiral trajectories, towards the axis 3 of the jig. The light fraction D flows out of the jig through the conduits 17 and 19, and the heavy fraction C, flows on the receiver and through the flap 16 into the conduit 11, the separated fraction E screened on sieve deck 7 flowing through the conduit 12, said fractions flowing to known dewatering devices.

What is claimed is:

1. A method for separation of a mixture of mineral grains having different specific gravities comprising introducing a raw mixture of mineral grains with water tangentially at the outer wall of a trough with an initial velocity to produce circulation of the stream of the mixture at least near an upper edge of said outer wall along a path around a central axis causing the mineral grains to selectively flow along spiral trajectories within the trough from the outer wall towards the central axis in accordance with the specific gravities of the grains, supplying pulsating water into said trough in alternate upward and downward direction to facilitate separation therein of the grains into light and heavy fractions along said spiral trajectories and discharging the separated light and heavy fractions separately into the region of the central axis in the trough.

2. A method as claimed in claim 1, comprising separating at said outer wall a first fraction of the finest grains in the raw material which does not flow inwardly in the trough.

3. A method as claimed in claim 1 wherein said light fraction of grains flows inwardly in said trough at an upper level therein, removing said light fraction at said upper level, the heavy fraction flowing inwardly and descending in said trough onto a conical base thereof whereon said grains travel inwardly, and discharging the heavy fraction from said conical base near the central axis.

4. A method as claimed in claim 3 comprising screening the heavy fraction flowing on said conical base so that the smaller particles drop through and are separated from the larger particles.

5. Apparatus for separation of a mixture of mineral grains having different specific gravities comprising a vessel having an upright outer wall of substantially cylindrical shape, a conically tapered second wall in said vessel defining with the upright wall an annular air chamber which is open at the bottom thereof, said outer wall having an upper end in the form of a trough which is open inwardly towards the central axis of the vessel, means for introducing a raw mixture of mineral grains with water tangentially into said trough to produce circulation of the grains and flow thereof inwardly along spiral trajectories in accordance with the specific gravities of the grains, means including a receiver for discharging a light fraction received at the trough in the region of said central axis, a sieve deck in the form of an inverted truncated cone having an outer edge supported on said second wall and an inner edge supported on said receiver, the heavy fraction of grains descending onto said sieve deck and flowing towards the central axis, means for discharging the heavy fraction from the sieve deck in the region of said central axis, and means for pulsating water in said vessel to facilitate separation of the grain into the light and heavy fractions comprising an annular surge tank for compressed air surrounding said outer wall beneath said trough, an annular collector for expanded air beneath the surge tank and air pulsator means coupled to said air chamber.

6. Apparatus as claimed in claim 5 wherein said trough includes a slotted sieve dividing the trough into inner and outer sections, the slots in said slotted sieve extending parallel to said upright wall.

7. Apparatus as claimed in claim 6 wherein said means for introducing raw mixture into the trough comprises at least one inlet nozzle tangentially disposed at the inner section of said trough, said outer section of the trough having a discharge outlet for water containing the lightest grains which do not flow along the spiral trajectories.

8. Apparatus as claimed in claim 5 comprising radial walls disposed on said second wall dividing said air chamber into a plurality of sections, said air pulsator means comprising an air pulsator for each section of the air chamber.

9. Apparatus as claimed in claim 8 comprising means subdividing said air chamber sections into further sections extending radially beneath the sieve deck and supplied by compressed air from said annular air chamber.

10. Apparatus as claimed in claim 5 wherein said receiver of the heavy fraction includes a valve flap controlling outflow of the heavy fraction, and drive means for operating said valve flap.

11. Apparatus as claimed in claim 10 wherein said means for discharge of the heavy fraction includes a pipe conduit, said valve flap being suspended on said pipe conduit.

* * * * *